United States Patent [19]

Churla

[11] 4,210,374

[45] Jul. 1, 1980

[54] SET-SCREW BUSHING INCLUDING INTEGRAL ELECTRICAL CLAMP

[75] Inventor: Daniel Churla, Old Forge, Pa.

[73] Assignee: Atlas Technologies Inc., Scranton, Pa.

[21] Appl. No.: 882,848

[22] Filed: Mar. 3, 1978

[51] Int. Cl.[2] ..... H01R 3/06

[52] U.S. Cl. ..... 339/14 L; 285/404

[58] Field of Search ..... 339/14 L; 285/404

[56] References Cited

U.S. PATENT DOCUMENTS

| | | | |
|---|---|---|---|
| 3,365,693 | 1/1968 | Browne | 339/14 L |
| 3,941,410 | 3/1976 | Miyaoka | 285/404 X |

*Primary Examiner*—Roy Lake
*Assistant Examiner*—DeWalden W. Jones
*Attorney, Agent, or Firm*—Caesar, Rivise, Bernstein & Cohen, Ltd.

[57] ABSTRACT

A set-screw bushing including integral electrical clamp for connection to the end of a threaded pipe, although in some instances the invention is usable with an unthreaded pipe, the bushing of this invention including clamping means for securing an electrical conductor to the bushing. The bushing and the clamping means are preferably cast as an integral unit of metal. The clamping means include a c-shaped member defining an open mouth with a lip to receive various sized electrical conductors. An adjustable lug screw extends into the mouth to secure a conductor to the lip when the screw is tightened.

The bushing preferably has a plain or unthreaded inner wall with the bushing being secured over the pipe by means of an adjustable set-screw extending through the bushing wall. A tab extends from the bushing wall to limit the amount of engagement between the bushing and the pipe. The upper edge of the bushing terminates in a rim which has a notch to permit ease of installation or insertion of an insulating piece within the bushing and against the rim.

With the present invention the bushing is quickly installed on the pipe with the set-screw forcing the tab against a thread of the pipe to achieve a tight grip.

12 Claims, 6 Drawing Figures

SET-SCREW BUSHING INCLUDING INTEGRAL ELECTRICAL CLAMP

This invention relates generally to electrical connectors and more particularly to pipe bushings including means for securing electrical conductors thereto.

Various bushings for securement to threaded pipe ends and having electrical conductor connecting devices (such as clamps for effecting the grounding of the pipe) are commercially available. Such devices commonly comprise a threaded bushing adapted to be screwed onto the end of a pipe. Conductor clamping means are secured to the bushing by the use of at least one screw.

The clamping means include a smooth mouth into which an adjustable set-screw extends. The electrical conductor is seated in the mouth and the set-screw tightened into contact with the conductor to secure the conductor in place.

While the clamping means of the prior art are generally suitable for their intended functions, they nevertheless suffer from various drawbacks, the most serious of which being that during storage, shipment, etc., the clamping means may come loose from the bushing and even be lost. In such an event the user must either reconnect the disconnected part or else get a replacement if the part is lost. For the occasional user, such action may only be a slight inconvenience, but in large scale construction applications the time lost by skilled workmen in connecting the bushing clamps can result in substantial increases in construction costs.

Another significant disadvantage of the prior art bushings including conductor clamping means is that such devices are of severly limited utility and cannot be used with various diameter electrical conductors. To that end, various sized clamps have to be kept in stock to accommodate various sized conductors.

The foregoing as well as other problems have been solved in prior co-pending application Ser. No. 760,484, entitled Bushing Including Integral Electrical Cable Clamp, the entire disclosure of which is incorporated herein by reference.

In said application Ser. No. 760,484, there was disclosed and claimed a bushing and electrical conductor clamping device which comprised a bushing body for securement to a pipe and clamping means integrally formed with the bushing body. The clamping means were in the form of a stationary c-shaped member defining a mouth with a lip at its entrance which was arranged to receive various diameter electrical conductors therein. The mouth included longitudinally extending serrations and releasably securable means in the form of a threaded lug extending into the mouth opposite the serrations.

While the aforesaid bushing and electrical conductor clamping device has served well, nevertheless, it suffered from a drawback in that the c-shaped clamping means could not be rotated in close quarters. In other words, if the aforesaid bushing were to be installed within a c-shaped or L-shaped panel, the clamping means would abut against a wall of the panel if it were attempted to rotate such clamping means in order to install the same upon a threaded pipe. This can best be understood by reference to FIG. 5 herein. Moreover, it was desired to achieve a quicker installation of the bushing on the pipe.

Accordingly, it is a general object of the present invention to achieve a set-screw bushing with conductor securing means which overcomes the aforesaid advantages.

It is a further object of the present invention to provide a bushing for connection to a pipe which has integrally formed clamping means to effect the securement of electrical conductors to the pipe.

It is still a further object of the present invention to provide a bushing for connection to a pipe which includes means for securing electrical conductors thereto with said connecting means being suitable for use with various diameter conductors.

Still another object of the present invention is to provide a bushing for connection to a pipe with integral clamping means, thereby precluding the separation of the clamping means from the bushing.

Yet another object of the present invention is to provide a set-screw bushing which can be installed in close quarters with reference to a c-shaped or L-shaped panel without the necessity of rotating the bushing during the securing process.

The foregoing as well as other objects of the present invention are achieved by providing a set-screw bushing including integral electrical clamp for connection to the end of a threaded or unthreaded pipe. The bushing of the present invention includes clamping means for securing an electrical conductor to the bushing. The bushing and the clamping means are preferably cast as an integral unit of metal. The clamping means includes a c-shaped member defining an open mouth with a lip to receive various size electrical conductors. An adjustable lug screw extends into the mouth to secure a conductor to the lip when the screw is tightened.

The bushing of this invention preferably has a plain or unthreaded inner wall with the bushing being secured over the pipe by means of an adjustable set-screw extending through the bushing wall. Thus, it is not necessary that the end of the pipe be threaded, although the present invention can be used with a pipe having external threads.

Another feature of the bushing of the present invention is a tab extending inwardly from the bushing wall, with a set-screw being provided to force the tab against a thread of the pipe to achieve a tight grip. Finally, the upper edge of the bushing terminates in a rim which has a notch to permit ease of installation or insertion of an insulating piece within the bushing and against the rim.

Other objects and many of the attendant advantages of this invention will be readily appreciated as the same becomes better understood by reference to the following detailed description when considered in connection with the accompanying drawing wherein.

Figure 1:
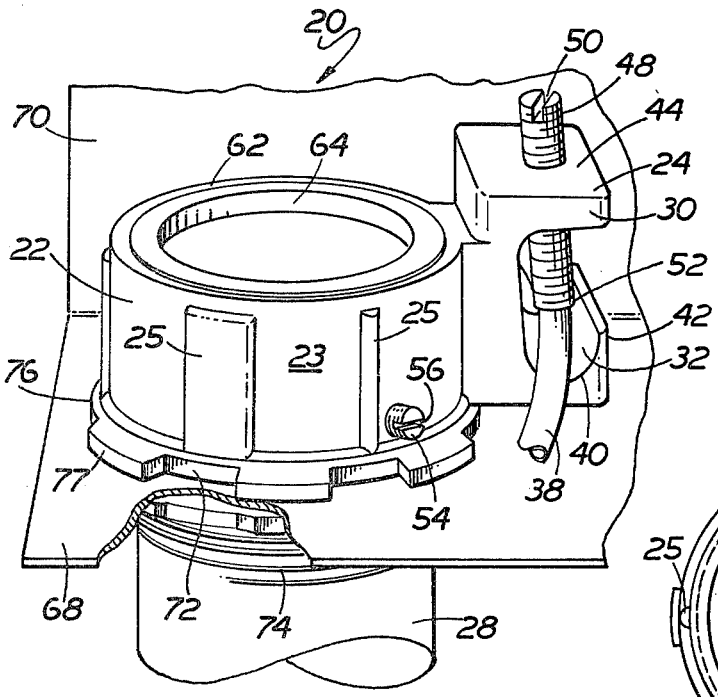
FIG. 1 is a three-dimensional view of a set-screw bushing in accordance with the present invention, with the bushing being secured to a pipe that extends through an opening in a c-shaped or L-shaped panel.

Referring now to the various figures of the drawing wherein like reference characters refer to like parts there is shown at 20 in FIG. 1 a set-screw bushing embodying the present invention. The set-screw bushing basically comprises a bushing body 22 and clamping means 24 secured thereto. The clamping means 24 and the bushing body 22 are preferably formed as an integral unit of a conductive metal, such as zinc. The bushing body 22 is hollow with its inner surface 26 being preferably plain and unthreaded. The outer surface 23 of the bushing body 22 contains a series of integral reinforcing struts or rods 25.

Figure 3:
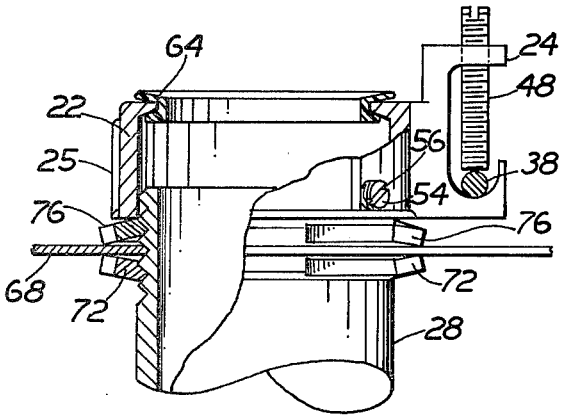
FIG. 3 is a side elevational view, partly in section, of the assembly shown in FIG. 1.
Figure 4:
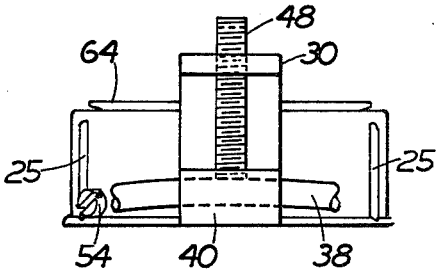
FIG. 4 is a front elevational view of the assembly shown in FIG. 1.

As shown in FIGS. 1 and 3, the bushing body 22 is received over a portion of the threaded end of pipe 28, although it will be appreciated that the bushing of the present invention may also be used with unthreaded pipe.

Figure 2:
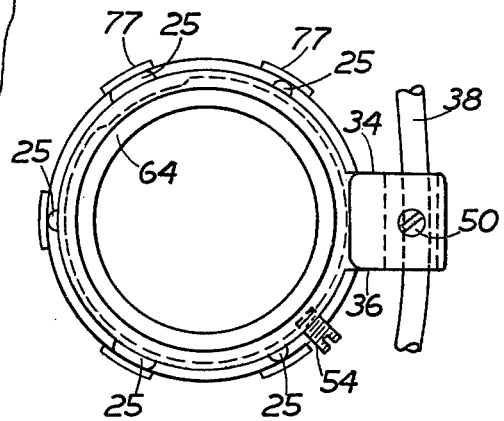
FIG. 2 is a top elevational view, of the assembly shown in FIG. 1.

The clamping means 24 comprises a c-shaped block 30 defining a mouth 32. The mouth extends the full width of the block, that is from side 34 to side 36 (see FIG. 2). The mouth 32 is adapted to receive an electrical conductor 38 longitudinally therein and to clamp the conductor into place. Thus, the bottom of the mouth forms a somewhat curved seat 40 for the conductor 38. The edge of the seat is in the form of an upwardly projecting lip 42 which also extends the full width of the block 30.

The portion of the c-shaped block disposed over the seat 40 is denominated by the reference numeral 44 and includes a threaded opening 46 therein. A threaded lug 48 extends through the opening 46 into the mouth 32 and toward the seat 40. The lug 48 includes a slotted end 50 to enable the lug to be positioned relative to the seat. The free end of the lug 48 (FIG. 1) is denominated by the reference numeral 52 and adapted to make contact with a portion of the periphery of the conductor 38 to clamp the conductor between it and seat 40, thus forming a good electrical connection.

Figure 6:
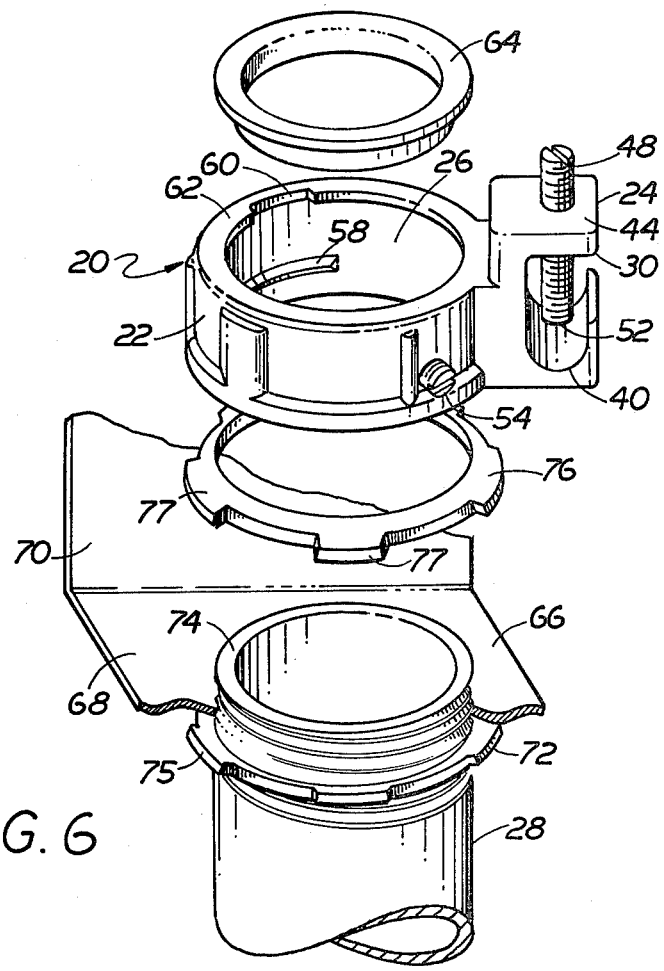
FIG. 6 is an exploded three-dimensional view of the assembly of FIG. 1.

It will be seen from FIGS. 1, 3 and 6, that the projecting lip 42 enables the clamping means 24 to be used with various sized electrical conductors from the relatively small size, e.g., number 14, to the relatively large size, e.g., number 4. Towards that end, as will be appreciated by those skilled in the art, that when clamping a relatively small diameter conductor the lip will act to keep such conductor from slipping out of the mouth of the clamping means.

In accordance with another aspect of the invention the bushing body 22 and the clamping means 30 are formed as an integral unit. This feature precludes the clamping means from being worked loose from the bushing body. In addition, it obviates the necessity for assembling the bushing body and the clamping means on the site.

Another feature of the invention involves the provision of an adjustable set-screw 54 which extends through an appropriate opening in the bushing body 22. As will be appreciated from FIG. 3, the internal portion of the set-screw (not shown) will bear against the outer surface of pipe 28 in order to hold bushing body 22 tightly against the outer surface of the pipe 28. The set-screw 54 may be adjusted through the engagement of a screw-driver or other device in its slotted end 56, and is tightening means.

As best shown in FIG. 6, tab 58 extends from inner surface 26 of bushing body 22. The tab 58 is forced by set-screw 54 against a thread of the pipe to achieve a tight grip that is quickly established.

Still another feature of the invention invovles the provision of a notch 60 in a rim 62 which is an integral part of the bushing. The notch 60 serves to permit ease of installation or insertion (as well as removal) of insulating piece 64 (FIG. 6).

Figure 5:
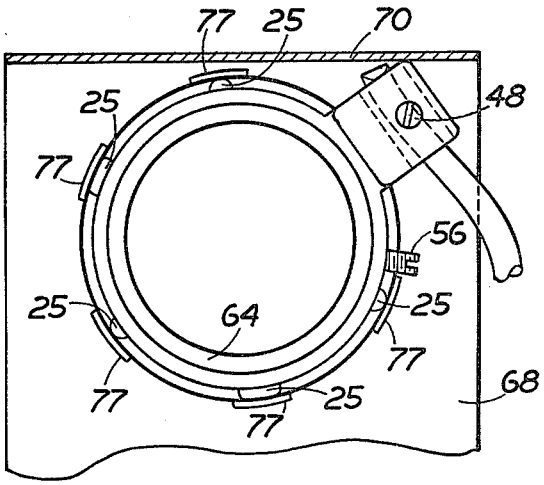
FIG. 5 is a top elevational view similar to FIG. 2 but showing the added presence of the c-shaped or L-shaped panel and the inability to install the set-screw bushing by rotating with reference to the pipe.

Operation of the device 20 is as follows:

A portion of the conductor 38 is extended into the mouth 32 of the clamping means 30 and positioned on the seat 40. The lug 48 is then tightened using its slotted end 50, to bring the free end 52 of the lug 48 into contact with the conductor 38. Further tightening of the lug 48 results in the tightening of the conductor between the free end of the lug 48 and the seat 40 of the block 30 to form good electrical connection. As will be seen the securement of conductor 38 to the clamping means 30 may be done before or after bushing 22 is installed upon pipe 28. The manner of installing bushing 22 on pipe 28 can be appreciated by a consideration of FIGS. 3 and 6. The pipe 28 is first secured to an L-shaped or c-shaped member 66 having horizontal panel 68 and vertical panel 70. An appropriate opening is provided in the horizontal panel 68. A nut 72 is first threaded on the pipe 28 for a sufficient amount so that a portion of the threads of pipe 28 extend beyond the nut 72. This threaded portion is then inserted through the opening in the horizontal panel 68. Another nut 76 is then employed to firmly secure the pipe 28 to the panel 68 by threading of the nut 76 upon the outer most threads of the pipe 28 as illustrated in FIG. 3. Bushing 20 is then simply slipped over the extending threads of the pipe 28 with the adjustable set-screw 54 then being tightened. It will be seen that it is not necessary to rotate the bushing 20 with reference to the pipe 28 nor, as shown in FIG. 5, is it even possible to rotate bushing 20 with reference to the pipe 28 for any significant amount.

As should be appreciated from the foregoing, the set-screw bushing of the present invention with its integral clamping means is so constructed as to be suitable for clamping small diameter wire as well as large diameter wire. This feature permits the device to handle minimum or maximum wire sizes, thereby eliminating the need for stocking various sized devices for each size pipe. It also eliminates the problems inherent in having to order various sized devices. Needless to say, the elimination of stocking various sized devices for each size bushing and pipe can result in substantial savings and reduce errors in production, shipping and ordering. The aforesaid advantages are gained without any loss in the effectiveness of the clamping means since the mouth in the seat of the c-shaped clamping member keeps the smaller diameter wires located while the screw is tightened. Moreover, the integral nature of the bushing and clamping means precludes accidental disassembly and loss of components and obviates an assembly step at the building site.

It will further be appreciated that the bushing 20 may be quickly assembled upon the extending threaded end of the pipe 28. All that is needed is to slip the bushing 20 over the threaded end of the pipe 28, followed by tightening of the adjustable set-screw 54. It does not matter whether the precise end of the pipe 28 is threaded, although such threads are necessary in order to achieve the locking of pipe 28 within the opening and horizontal panel 68 using nuts 72 and 76.

Without further elaboration, the foregoing will so fully illustrate my invention that others may, by applying current or further knowledge, readily adapt the same for use under various conditions of service.

This application is a continuation-in-part based on application Ser. No. 760,484, filed Jan. 19, 1977 and entitled Bushing Including Integral Electrical Cable Clamp.

What is claimed as the invention is:

1. In a set-screw bushing comprising an annual bushing body having an unthreaded inner surface for securement in a slip fit over a pipe having a threaded end, and integral, inseparable electrical conductor clamping means extending away from said bushing body, adjustable pipe tightening means spaced from said clamping means, said pipe tightening means extending through said bushing body to bear inwardly against said pipe to hold said bushing body in fixed position about said pipe, tab means, integral with said bushing body, said tab means extending inwardly from said bushing body to contact said pipe, whereby said tightening means may be advanced inwardly against said pipe so as to force said pipe against said tab means to achieve a firm union of said bushing body and said pipe.

2. The bushing of claim 1 wherein said tightening means is an adjustable set-screw threadedly engaging said bushing body and adapted to abut against said pipe.

3. The bushing of claim 2 wherein said pipe possesses a threaded outer wall for a portion of its length and said set-screw bears against at least one of said threads.

4. The bushing of claim 3 wherein said tab means contacts at least one of said threads.

5. The bushing of claim 4 wherein said threaded pipe end passes through an opening in a panel and is secured to said panel by nuts.

6. The bushing of claim 1 wherein said clamping means is a c-shaped member defining a mouth having a lip at its entrance and arranged to receive various diameter electrical conductors therein.

7. The bushing of claim 6 and further including releasable securable means in the form of a threaded lug extending into said mouth to clamp a conductor within said mouth.

8. The bushing of claim 7 wherein said threaded lug includes a slotted end.

9. The bushing of claim 8 wherein said c-shaped member and said bushing are cast as an integral unit.

10. The bushing of claim 9 wherein said integral unit is formed of metal.

11. The bushing of claim 10 wherein said metal is zinc.

12. The bushing of claim 1 wherein the upper edge of said bushing terminates in a rim which has a notch to permit installation or removal of an insulating piece within the bushing and cast against the rim.

* * * * *